US009527088B2

(12) United States Patent
Haalisto

(10) Patent No.: US 9,527,088 B2
(45) Date of Patent: Dec. 27, 2016

(54) BLADE BIT FOR CRUSHER ROTOR

(75) Inventor: Ilkka Haalisto, Rauma (FI)

(73) Assignee: BMH TECHNOLOGY OY, Rauma (FI)

( * ) Notice: Subject to any disclaimer, the term of this patent is extended or adjusted under 35 U.S.C. 154(b) by 301 days.

(21) Appl. No.: 13/701,590

(22) PCT Filed: Jul. 6, 2011

(86) PCT No.: PCT/FI2011/050635

§ 371 (c)(1),
(2), (4) Date: Dec. 3, 2012

(87) PCT Pub. No.: WO2012/004456

PCT Pub. Date: Jan. 12, 2012

(65) Prior Publication Data

US 2013/0082131 A1 Apr. 4, 2013

(30) Foreign Application Priority Data

Jul. 7, 2010 (FI) ..... 20105777

(51) Int. Cl.
*B02C 18/18* (2006.01)
*B02C 18/16* (2006.01)
*B02C 18/14* (2006.01)

(52) U.S. Cl.
CPC ..... *B02C 18/18* (2013.01); *B02C 18/145* (2013.01); *B02C 18/16* (2013.01)

(58) Field of Classification Search
CPC ..... B02C 18/18; B02C 18/14; B02C 13/28; B02C 18/16; B02C 18/145; B02C 2018/188
USPC ..... 241/195, 291, 293, 294, 191, 189.1, 241/197, 300; 144/241
See application file for complete search history.

(56) References Cited

U.S. PATENT DOCUMENTS

| | | | | | |
|---|---|---|---|---|---|
| 3,629,919 | A * | 12/1971 | Trevarrow, Jr. | ..... | 407/103 |
| 4,209,047 | A * | 6/1980 | Weill | ..... | 144/208.8 |
| 4,315,706 | A * | 2/1982 | Erkfritz | ..... | 407/101 |
| 5,927,622 | A * | 7/1999 | Zoellinger | ..... | 241/27 |
| 6,154,948 | A * | 12/2000 | Williams, Jr. | ..... | 29/464 |
| 6,203,251 | B1 * | 3/2001 | Oppelt et al. | ..... | 407/48 |
| 6,394,378 | B1 * | 5/2002 | Ragnarsson | ..... | 241/294 |
| 6,494,394 | B1 * | 12/2002 | Balvanz et al. | ..... | 241/197 |
| 6,520,440 | B2 * | 2/2003 | Ragnarsson | ..... | 241/294 |
| 6,837,453 | B2 * | 1/2005 | Sturm | ..... | 241/243 |
| 7,004,413 | B2 * | 2/2006 | Langlois | ..... | 241/242 |
| 7,293,729 | B2 * | 11/2007 | Ragnarsson | ..... | 241/197 |
| 7,634,897 | B2 * | 12/2009 | MacLennan et al. | ..... | 56/13.6 |
| 7,913,432 | B2 * | 3/2011 | MacLennan et al. | ..... | 37/454 |
| 7,959,099 | B1 * | 6/2011 | Cox et al. | ..... | 241/294 |
| 8,061,642 | B2 * | 11/2011 | Chang | ..... | 241/294 |

(Continued)

*Primary Examiner* — Faye Francis
(74) *Attorney, Agent, or Firm* — Ladas & Parry LLP

(57) ABSTRACT

A blade bit for attachment to a chuck in an envelope surface of a crusher rotor. The blade bit (1) having four corners and being arranged for being attached to the chuck such that an angular-shaped tip of the blade bit points outwardly from the envelope surface, substantially in the radial direction of the rotor. A rear surface of the blade bit acts as an attachment surface to the chuck and includes a support surface (9) preventing the blade bit from rotating. The support surface also enables sliding of the blade bit towards the envelope surface (3), when the blade bit is being attached, until the blade bit is supported to the envelope surface.

5 Claims, 2 Drawing Sheets

(56) References Cited

U.S. PATENT DOCUMENTS

Figure 1:
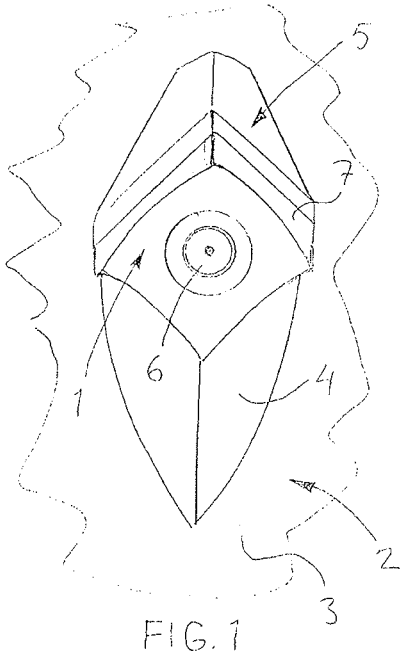

| | | | | |
|---|---|---|---|---|
| 2001/0038049 | A1* | 11/2001 | Paper | B02C 18/18 241/189.1 |
| 2003/0075628 | A1* | 4/2003 | Pretzler | B02C 18/0084 241/243 |
| 2011/0100383 | A1* | 5/2011 | Tilley et al. | 131/280 |
| 2011/0290920 | A1* | 12/2011 | Kim et al. | 241/25 |
| 2012/0199678 | A1* | 8/2012 | Cassani et al. | 241/69 |

* cited by examiner

BLADE BIT FOR CRUSHER ROTOR

RELATED APPLICATION INFORMATION

This application is a 371 of International Application PCT/FI2011/050635 filed 6 Jul. 2011 entitled "Blade Bit for Crusher Rotor", which was published in the English language on 12 Jan. 2012, with International Publication Number WO 2012/004456 A1, and which claims priority from Finnish Patent Application No. 20105777 filed on 7 Jul. 2010, the content of which is incorporated herein by reference.

BACKGROUND OF THE INVENTION

The invention relates to a blade bit to be attached to a chuck in an envelope surface of a crusher rotor, the blade bit having four corners and arranged for being attached to the chuck such that an angular-shaped tip of the blade bit pointing outwardly from the envelope surface, substantially in the radial direction of the rotor, whereby the rear surface of the blade bit, which acts as its attachment surface to the chuck, comprises a support surface, that prevents the blade bit from rotating and that also enables sliding of the blade bit towards the envelope surface, when the blade bit is being attached, until the blade bit is supported to the envelope surface.

The crushers typically employ dynamic and static blades. All blades may also be dynamic.

The blades may be made of various materials, such as steels. Blade properties may be improved in various ways, such as thermal treatments and coatings. The thermal treatment allows sufficient endurance and functionality to be achieved against wear and impacts. The blades must also stay sharp in operations where cutting is required.

The blades may also be coated by using various methods that include, for instance, detonation, PTA (Plasma Transferred Arc) spraying, HVOF (High Velocity Oxygen Fuel Thermal Spray Process), laser hybrid welding/melting processes, when coatings used are typically powders, in which carbides and metal powders are combined. For welding it is also possible to use MIG, MAG and TIG welding, metal arc welding and various soldering methods.

The blades may be attached to chuck structures of a crusher rotor with bolted joints or other attachment arrangements.

When crushing materials that are elastic or soft, it is common to use blade technology that is based on cutting the material. For a successful operation it is essential that cutting allowance is as small as possible. In practice, this requirement also necessitates allowance adjustment so as to compensate for wearing.

It is known technology to use as cutting blades replaceable blade bits having the basic shape of a square and the front surface that is either flat or concave. They are attached to chucks on the envelope surface of the crusher rotor by using a screw passing through the chuck such that it utilizes the blade bit as a nut. A corner of the blade bit square points thus outwardly from the envelope surface in the radial direction of the rotor. Lateral positioning is typically provided by means of a V-groove on the rotor surface and a large hole in the chuck.

As the tip of the blade bit and the cutting edges downwardly therefrom wear (become dull), the cutting capacity degrades and a need for force increases. In that case the blade bit is rotated 90 degrees or 180 degrees and consequently sharp edges and a tip will be in use.

After rotation, the blade surfaces used for support are typically worn and consequently the guiding effect in the V-groove of the envelope surface of the crusher rotor is not necessarily appropriate. The blade may also assume a slightly slanted position, if one blade bit side is more worn than the other. This, in turn, has a consequence that blade allowance adjustment, which often takes place by adjusting blocks consisting of several blade bits, cannot achieve the desired allowance. The slanted blade bit defines the allowance of the whole adjustment block, and typically, the allowance is clearly larger than desired.

SUMMARY OF THE INVENTION

The object of the present invention is thus to provide an improved blade bit for a crusher rotor of the above type, by which the above-mentioned problems may be solved. This objective is achieved by a blade bit of the invention, which is characterized in that a support surface comprises at least one groove passing substantially in the diagonal direction through the opposing corners of the blade bit, and that in the whole consisting of the blade bit and its chuck there is also arranged a structure preventing the blade bit from wobbling, which structure consists of continuous, raised edge zones of either one or both of the surfaces to be placed against one another.

Preferred embodiments of the invention are disclosed in claims 2 to 5.

Previously, blade bits and chuck structures having a flat surface have been used, and only a V-groove, into which the chuck structure is arranged, has prevented the blade bit from rotating. In that case, in the final tightening stage of blade mounting the blade has tended to twist and detach from the support surfaces provided by the V-groove. After thermal treatment, the flat support surface of the rear of the blade bit becomes convex, whereby the blade wobbles in the chuck structure.

The solution of the invention eliminates in a simple manner all the problems encountered in previous blade bit attachment techniques.

LIST OF FIGURES

Figure 2:
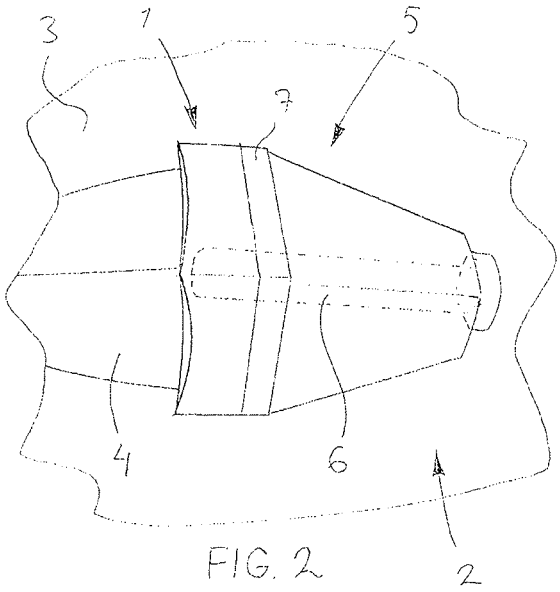
Figure 3:
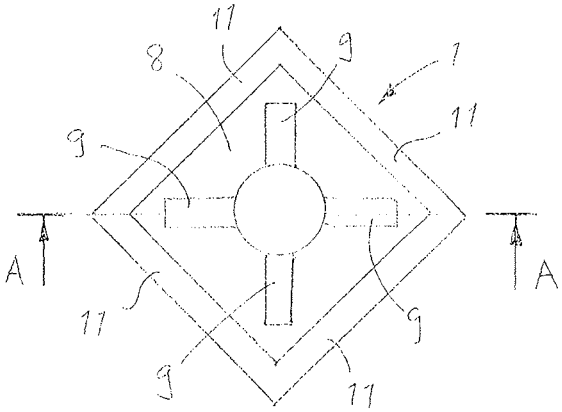
Figure 4:
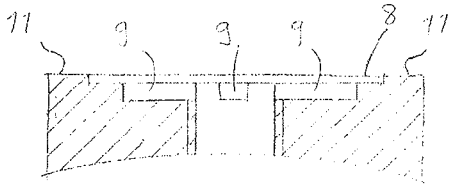
Figure 5:
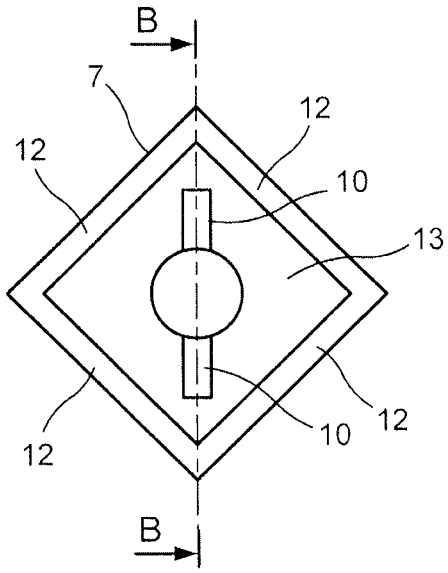
Figure 6:
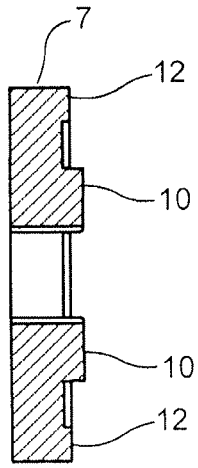
Figure 7:
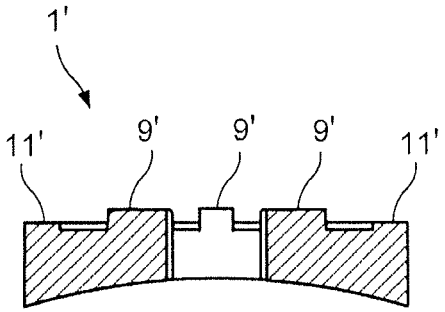
Figure 8:
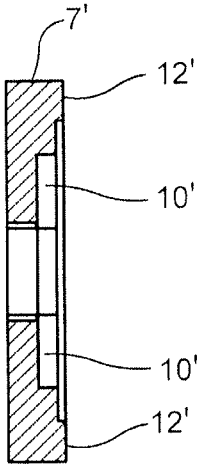

The invention will now be described in more detail by means of some preferred exemplary embodiments, with reference to the attached drawings, in which FIG. 1 is a perspective view of a blade bit for a crusher rotor and attachment thereof to a surface of the crusher rotor seen obliquely from the front, FIG. 2 is a perspective side view of a blade bit for a crusher rotor and attachment thereof to a surface of the crusher rotor, FIG. 3 is a rear view of the blade bit of the invention, FIG. 4 is a sectional view along A-A of the blade bit of FIG. 3, FIG. 5 is a front view of a chuck or hammering protection used in connection with the blade bit of the invention, FIG. 6 is a sectional view along B-B of the chuck or hammering protection of FIG. 5, FIG. 7 is a cross-sectional view, similar to that in FIG. 4, of a second blade bit that does not form part of the invention presently claimed, and FIG. 8 is a cross-sectional view, similar to that in FIG. 6, of a second chuck or hammering protection used in connection with a blade bit that does not form part of the invention presently claimed.

DETAILED DESCRIPTION OF THE INVENTION

With reference to FIGS. 1 and 2, they show a blade bit 1, which is attached to a chuck 5 locating in a V-groove 4 on an envelope surface 3 of a crusher rotor 2 with a screw 6 passing centrally through the blade bit 1. The blade bit 1 has four corners (a square or a quadrangle typically having right angles) and it is attached to the chuck 5 such that an angular-shaped tip of the blade bit points substantially outwardly from the envelope surface 3 in the radial direction of the rotor 2. The chuck 5 may comprise a replaceable hammering protection 7 used in this example between the chuck 5 and the blade bit 1.

According to the invention, the blade bit's 1 rear surface 8, which acts as its attachment surface to the chuck 5 or hammering protection 7, comprises a support surface preventing the blade bit 1 from rotating, the support surface comprising, in the example of FIGS. 3 and 4, grooves 9 substantially in parallel with the diagonal lines of the square through the tips of the blade bit 1 and in alignment therewith. In that case, the chuck 4 or the hammering protection 5 have a counterpart support surface 13 with counterpart protrusions 10 cooperating with the grooves 9, i.e. counterpart protrusions 10 appearing in FIGS. 5 and 6, which may be arranged with a selected sliding fit into the grooves 9. In this example, the counterpart protrusions 10 are arranged only for the grooves 9 of the blade bit 1 in the radial direction of the crusher rotor 2. When the blade bit 1 is being attached, the counterpart protrusions 10 enable the blade bit 1 to be slid towards the envelope surface 3 until the blade bit 1 is supported to the envelope surface 3.

In the implementation of FIGS. 7 and 8, which is not inventive, the grooves and the protrusions may also change places in the blade bit 1' and the chuck or the hammering protection 7'. So, the blade bit 1' comprises the protrusions 9', and the chuck or the hammering protection 7' comprises the grooves 10'. The blade bit 1' comprises raised edge zone 11' and chuck or hammering protection 7' comprises raised edge zone 12'.

The number, orientation and shape, as well as the cross-sectional shape, of the above described grooves 9 and protrusions 10 may controllably allow a transition or adjustment of the blade bit 1 in the height direction. Advantageously, the blade bit 1 may be rotated here at 90-degree intervals, whereby all four cutting edges of the blade bit 1 may be used and "worn out" before the bade bit 1 is to be replaced.

The blade bit 1 being provided with grooves 9, the front surface (cutting surface) thereof may be reinforced, if necessary, so as to compensate for the weakening effect of the grooves 9. Actual impacts directed to the blade bits 1 are still to be received by the support surfaces formed by the flanks of the V-groove 4 in the envelope surface 3 of the crusher rotor 2.

In the above-described examples, in the whole consisting of the blade bit 1 and its chuck 5, 7 there is also arranged a structure that prevents the blade bit 1 from wobbling, the structure consisting of raised edge zones 11, 12, which may be continuous or discontinuous, of either one or both of the surfaces to be placed against one another. Thus, the structures that are mainly peripherally supported against one another are not able to wobble.

All above-described support surfaces, including grooves 9 and protrusions 10, preventing the blade bit 1 from rotating and structures 11, 12 preventing it from wobbling may be manufactured by machining or by using some other suitable manner. The protrusions 10, and possible also the raised edge zones 11, 12, may also be separate elements attached to each particular part in a suitable manner.

The hammering protection 7 may likewise be manufactured of various steel grades and heat treated, tempered, coated, etc., in a suitably selected manner. The purpose of the hammering protection 7 is to protect the chuck 5 that is attached to the envelope surface 3 of the crusher rotor 2 and that is cumber-some to replace.

The size of the blade bit, 1, 1' of the invention, in turn, is in the order of 40 mm×40 mm to 150 mm×150 mm, because it is employed in a relatively heavy-duty crusher.

The above description of the invention is only intended to illustrate the basic idea of the invention. A person skilled in the art may, however, implement the basic idea of the invention in a variety of ways. The invention and its embodiments are thus not restricted to the examples described above, but they may vary within the scope of the attached claims.

The invention claimed is:

1. A combination comprising a chuck, a blade bit for attachment to the chuck and a crusher rotor having an axis and an envelope surface formed as a surface of revolution about the axis, the chuck being disposable in the envelope surface of the crusher rotor, wherein the blade bit comprises four corners, an angular-shaped tip, and a rear surface comprising a support surface, wherein the blade bit is configured to be attached to the chuck in an operative configuration with the angular-shaped tip of the blade bit pointing outwardly from the envelope surface substantially in a radial direction of the rotor, with the rear surface of the blade bit attached to the chuck and with the support surface preventing the blade bit from rotating, the support surface of the blade bit being configured to enable sliding of the blade bit towards the envelope surface when the blade bit is being attached to the chuck until the blade bit is supported to the envelope surface in the operative configuration, wherein the support surface of the blade bit comprises a first groove oriented substantially along a diagonal that passes through a first set of opposing corners of the blade bit, and wherein the rear surface of the blade bit also comprises an anti-wobble structure that interacts with the chuck on a counterpart support surface of the chuck to prevent the blade bit from wobbling when the rear surface of the blade bit is disposed against the counterpart surface of the chuck with the blade bit attached to the chuck in the operative configuration, said anti-wobble structure and chuck collectively forming continuous raised edge zones that provide peripheral support for the rear surface of the blade bit against the counterpart surface of the chuck that prevents the blade bit from wobbling in the operative configuration, wherein the chuck comprises a counterpart protrusion that is arranged such that the counterpart protrusion fits within the first groove in the rear surface of the blade bit with the blade bit attached to the chuck in the operative configuration; and wherein the chuck comprises a replaceable hammering protection member and the counterpart support surface is disposed on the hammering protection member, wherein the support surface of the blade bit comprises, in addition to the first groove, a second groove oriented substantially along a second diagonal that passes through a second set of opposing corners of the blade bit, and wherein the counterpart support surface comprises a plurality of counterpart protrusions that protrude in a single radial direction of the rotor only such that, with the blade bit attached to the chuck in the operative configuration, only one of the first or the second groove is fitted with a protuberance from the counterpart support surface.

2. The combination of claim 1, wherein the support surface comprises a plurality of grooves that are substantially parallel with diagonals of the blade bit.

3. The combination of claim 1, wherein the support surface comprises a plurality of grooves that are substantially in alignment with diagonals of the blade bit.

4. The combination of claim 1, wherein the blade bit has a size that is substantially within a range of 40 mm×40 mm to 150 mm×150 mm.

5. The combination of claim 1, wherein the chuck comprises a raised edge zone.

* * * * *